US008015743B2

(12) United States Patent
Rhoades et al.

(10) Patent No.: US 8,015,743 B2
(45) Date of Patent: Sep. 13, 2011

(54) LASER EMITTER MOUNTING SYSTEM FOR LARGE CALIBER GUNS

(75) Inventors: William R. Rhoades, Plain City, OH (US); Donn Gier, Plain City, OH (US)

(73) Assignee: American Apex Corporation, Plain City, OH (US)

( * ) Notice: Subject to any disclaimer, the term of this patent is extended or adjusted under 35 U.S.C. 154(b) by 293 days.

(21) Appl. No.: 12/018,012

(22) Filed: Jan. 22, 2008

(65) Prior Publication Data

US 2011/0168010 A1 Jul. 14, 2011

Related U.S. Application Data

(60) Provisional application No. 60/885,953, filed on Jan. 22, 2007.

(51) Int. Cl.
*F41G 1/00* (2006.01)

(52) U.S. Cl. ..... 42/116; 89/29

(58) Field of Classification Search ..... 42/116, 42/117, 121, 146, 77; 33/263, 286; 89/29, 89/37.04

See application file for complete search history.

(56) References Cited

U.S. PATENT DOCUMENTS

| | | | | |
|---|---|---|---|---|
| 2,773,309 | A * | 12/1956 | Elliott | 42/134 |
| 3,782,832 | A * | 1/1974 | Hacskaylo | 356/153 |
| 4,481,561 | A * | 11/1984 | Lanning | 362/111 |
| 4,761,907 | A * | 8/1988 | De Bernardini | 42/106 |
| 5,241,458 | A * | 8/1993 | Abbas | 362/110 |
| 5,365,669 | A * | 11/1994 | Rustick et al. | 42/116 |
| 5,392,550 | A * | 2/1995 | Moore et al. | 42/117 |
| 5,531,040 | A * | 7/1996 | Moore | 42/115 |
| 5,787,631 | A * | 8/1998 | Kendall | 42/116 |
| 5,909,951 | A * | 6/1999 | Johnsen et al. | 362/111 |
| 6,050,170 | A * | 4/2000 | Guiette et al. | 89/29 |
| 6,606,797 | B1 * | 8/2003 | Gandy | 33/227 |
| 6,631,580 | B2 * | 10/2003 | Iafrate et al. | 42/134 |
| 7,681,483 | B1 * | 3/2010 | Rhoades et al. | 89/29 |
| 2002/0129536 | A1 * | 9/2002 | Iafrate et al. | 42/134 |

* cited by examiner

*Primary Examiner* — Bret Hayes
*Assistant Examiner* — Reginald Tillman, Jr.
(74) *Attorney, Agent, or Firm* — Standley Law Group LLP

(57) ABSTRACT

A system and method for mounting large caliber guns with a laser emitter is disclosed. The laser emitter mounting system includes an elongated tubular member for insertion into a gun chamber. The elongated tubular member is compressively secured within the gun bore. A mounting surface for a laser emitter and a breech assembly detachably engaged with the elongated tubular member by an anti-roll plate.

17 Claims, 3 Drawing Sheets

LASER EMITTER MOUNTING SYSTEM FOR LARGE CALIBER GUNS

CROSS-REFERENCE TO RELATED APPLICATIONS

This Non-provisional patent application claims priority to U.S. provisional application No. 60/885,953, filed on Jan. 22, 2007, which is expressly incorporated herein by reference.

TECHNICAL FIELD

The disclosed embodiments of the present invention are in the field of weapons such as for military ordnance. In particular, one exemplary embodiment relates to a weapons training system which uses an in-bore laser emitting device to provide cost effective operator training.

BACKGROUND OF THE ART

Large munitions are expensive and dangerous to operate. However, there is a need to train soldiers so that they will be combat-ready in the event an actual conflict should arrive. In connection with training and practice use of larger caliber guns such as the main gun on a tank, it is common practice to insert into the barrel of the larger caliber gun, a device that is the size of the shell that would normally be placed inside the larger caliber gun, but instead contains centrally disposed therein, a smaller caliber weapon. Thus, when this weapon is fired, it simulates the direction and accuracy of the larger caliber gun for training and practice purposes but reduces the costs of the exercise dramatically.

While cost effective, these systems still have certain drawbacks. Although the smaller caliber rounds are cheaper, they still use live ammunition. Therefore, sub-caliber systems are inappropriate for certain types of training, such as force-on-force.

A particularly promising development is the Multiple Integrated Laser Engagement System or MILES system used by the United States Armed Forces and other armed forces around the world for training purposes. It uses lasers to simulate actual battle. In large caliber weapons these lasers are often placed inside the bore of the main gun chamber.

Under the MILES system, individual targets carry laser receivers, which detect when the target has been successfully "hit" by another firearm's laser. Each laser transmitter is set to mimic the effective range of the weapon on which it is used. Often these systems are coupled with a real-time datalink allowing position and event data to be transmitted back to a central site for data collection and display. Thus, when this laser is employed it simulates the targeting of the larger caliber gun for training and practice purposes but reduces the costs of such armament dramatically. Furthermore, the selected laser is not hazardous to those involved. Therefore, the system is appropriate for force-on-force exercises Unfortunately, the laser systems currently employed for large caliber guns, such as the 120 mm M256 cannon found on the United States M1-series tank, lack effective means for mounting and centering the laser beam within the main gun bore. Therefore, current systems have proven to be inaccurate, imprecise, and cumbersome to employ in the field. Thus, their value as a training tool has been greatly diminished.

Because the military needs to repeatedly alternate between the training device and live ammunition, the device must be easy to install and quickly ready to use. When installed, the beam-alignment of the laser should most nearly match that of the main gun bore without the need for extensive independent calibration procedures. A negative aspect of current systems is that they lack means to consistently position the laser within the chamber. Therefore, current systems must be re-calibrated every time they are installed. The calibration process can be tedious and time consuming, and therefore, may absorb valuable training hours.

It is also desirable to provide a training device that requires the active participation of all those who would be involved in a real mission. Under current systems, the individual responsible for loading the shell in actual combat is often neglected in the training exercise. Therefore, there is an unmet need for a device which can require the active participation of the loader in the training firing sequence.

An exemplary embodiment of the present invention may meet some or all of the aforementioned needs.

SUMMARY OF THE INVENTION

This and other unmet needs of the prior art may be met by a device as described in more detail below. Applicant has devised a laser mounting system that will quickly and precisely position a laser emitter within a large caliber gun.

An exemplary embodiment of this invention may provide a mounting system to quickly outfit an existing large caliber barrel with a laser emitter which may be used in training exercises. A further advantage of at least one exemplary embodiment is that the laser, so mounted, may possess an alignment most nearly matching that of the main gun bore. Therefore, no independent calibration procedures may be required beyond the standard bore sighting performed on the main gun bore. Yet another advantage of an exemplary embodiment of this invention is that the laser mounting system may be easily disengaged and reinstalled while still maintaining the lasers precise alignment and position within the barrel. Furthermore, when used in combination with another portion of an exemplary embodiment of this device, the device may not rotate within or back out of the main gun bore during training conditions. Still further, an exemplary embodiment of this invention may facilitate training by involving the loader in the simulation.

BRIEF DESCRIPTION OF THE DRAWINGS

A better understanding of the exemplary embodiments of the invention will be had when reference is made to the accompanying drawings, wherein identical parts are identified with identical reference numerals, and wherein.

DETAILED DESCRIPTION OF EXEMPLARY EMBODIMENTS

Figure 1:
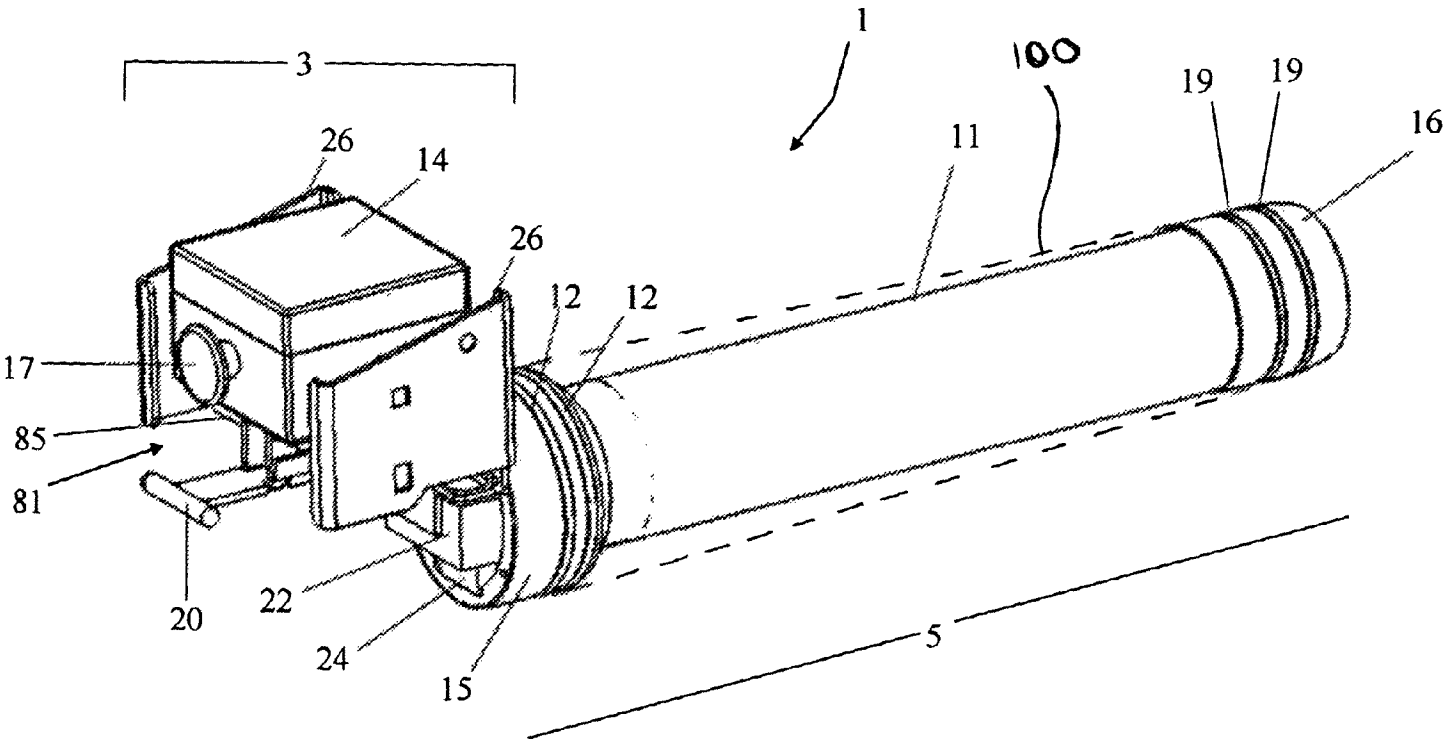
FIG. 1 is a first perspective view of an embodiment with the proximal end of the mounting system in the foreground as it would appear installed in the main gun chamber.

Referring now to FIG. 1, an exemplary embodiment of the laser emitter mounting system 1 comprises a breech assembly 3 detachably engaged with a mounting assembly 5. With respect to the mounting assembly 5, a tubular member 11 may connect and support forward adapter 16 and aft adapter 15. A mounting block 24 may be detachably fixed to the interior surface of aft adapter 15. A laser emitter 22 may be seated on mounting block 24 so as to precisely align the laser inside the mounting assembly 5, preferably at the concentric center of the mounting assembly 5. In this embodiment, adapters 15 and 16 have a diameter slightly less than, but approximating, the barrel diameter at their respective locations when slidably engaged within the main gun barrel 100. In an exemplary embodiment, forward and aft O-rings 19 and 12 are positioned on their respective adapters to provide a removably fixed interface with the proximal interior surface of the main gun bore 100. When installed, breech assembly 3 securely seats the mounting assembly 5 in position by engaging an anti-roll plate which is secured to the proximal surface of aft adaptor 15. The breech assembly 3 comprises a U-shaped member 81 that is composed of a cross-member 85 connecting oppositely disposed parallel sides 26. The U-shaped member 81 is designed and is of such a shape as to fit securely in the mortises of the breech ring of the main gun. The U-shaped member 81 may have structure to house a spring loaded piston assembly which is engaged by lever 20. A loader interface box 14 may be secured to cross-member 85 and may be in electrical communication with the laser emitter and/or the electrical triggering mechanism of the main gun 100. The loader interface box 14 may have a loader interface button 17.

Figure 2:
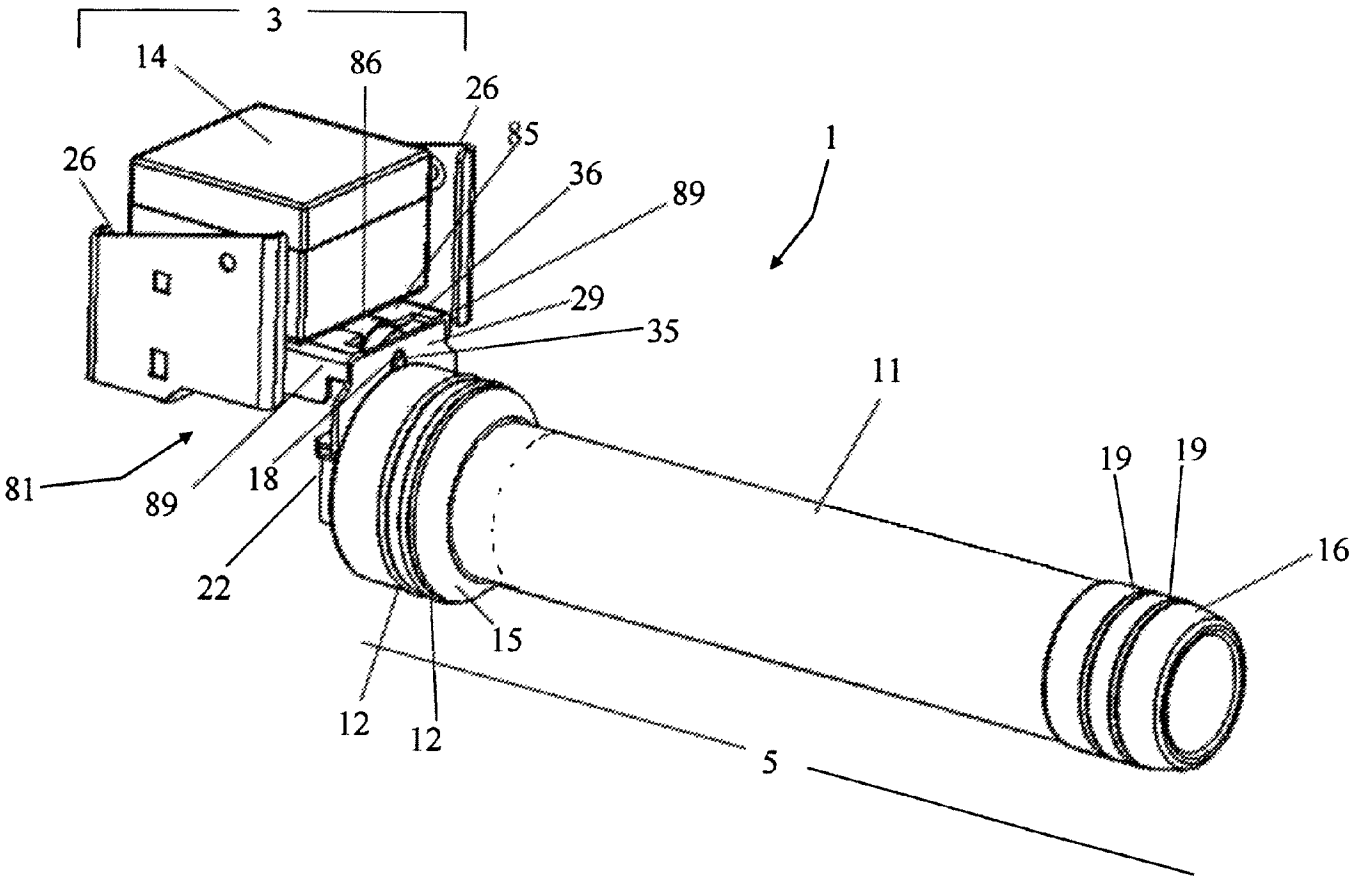
FIG. 2 is a second perspective view of an embodiment showing the distal end of the mounting system in the foreground as it would appear installed in the main gun chamber.

Referring now to FIG. 2, the posterior side of the breech assembly 3 is shown with cross-member 85 connecting oppositely disposed parallel sides 26. Cross-member 85 may have forwardly extending arms 89 which project forward to capture anti-roll plate 29. In this figure, the breech assembly 3 is shown fully engaged with the anti-roll plate 29. When the breech assembly 3 engages the anti-roll plate 29, the mounting assembly 5 is prevented from rotating in either direction. An optional piston assembly with optional spring-loading may be provided with the breech assembly 3. When the breech assembly 3 is correctly seated on the mounting assembly 5, the piston cylinder housing 86 is in line so that its piston 35 may penetrate anti-roll plate 29 at aperture 18, as shown. The piston assembly may be engaged by lowering the lever arm 20 shown in FIG. 1. When the piston engages, piston shoulder 36 abuts anti-roll plate 29 and provides a compression force on anti-roll plate 29 such that mounting assembly 5, so attached to the breech assembly 3, is prevented from backing out of the main gun 100 bore during operations. Besides receiving the breech assembly 3, anti-roll plate 29 also provides a stop analogous to that provided by the rim of a standard shell casing.

Figure 3:
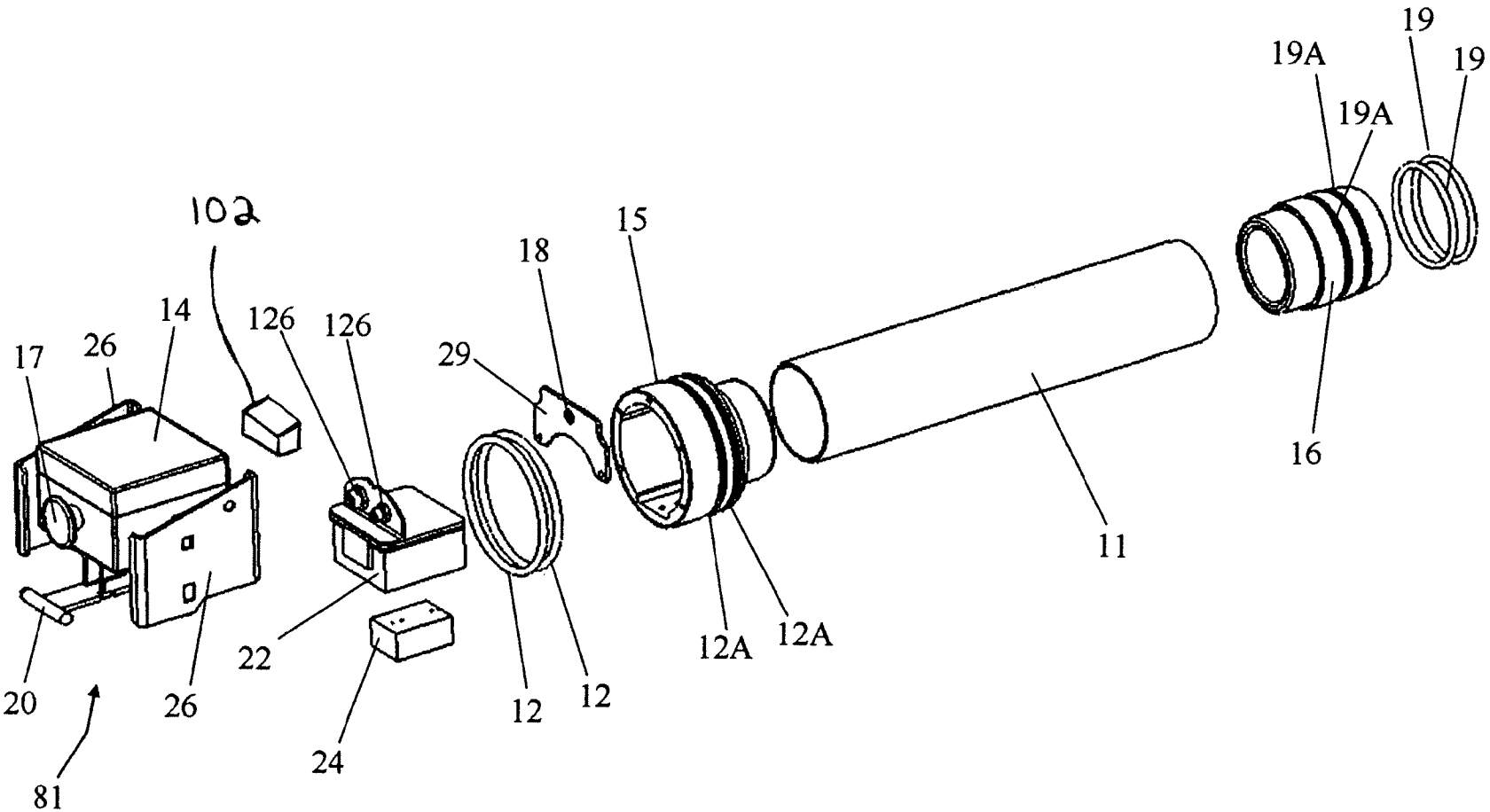
FIG. 3 is an exploded perspective view of an embodiment of the mounting system.

Referring now to FIG. 3, shown is an exploded view of an exemplary embodiment showing the breech assembly 3 with loader interface box 14, a laser emitter 22 with electrical communication ports 126, mounting block 24, aft O-rings 12, anti-roll plate 29, aft adaptor 15 with grooves 12A, tubular member 11, forward adaptor 16 with grooves 19A, and forward O-rings 19. Grooves 19A and 12A can accommodate and retain O-rings. Tubular member 11 may be used to connect and support forward adaptor 16 and aft adaptor 15 such that a laser passing through the center of mounting assembly 5 would pass through the concentric centers of both adaptors. The anti-roll plate 29 is attached to the base of mounting assembly 5 simulating the cartridge case of a larger caliber weapon.

In one exemplary operational embodiment, mounting assembly 5 is slideably inserted into the main gun chamber in the same manner as a live round. Upon inserting the mounting assembly 5 into the main gun chamber, the O-rings compress within the main gun bore 100 to provide constant seating and maintain the accuracy of the device. Laser emitter 22 is suspended within the main gun bore 100 such that the laser is aligned with the concentric center of the bore. After the mounting assembly 5 is fully seated in the main gun chamber, the breech assembly 3 is placed in position in the mortises of the breech ring of the main gun 100 until it seats on the anti-roll plate 29. Thereafter, lever 20 is moved downwardly so that piston 35 may engage the aperture 18 so that piston shoulder 36 abuts anti-roll plate 29 providing a compressive force on the mounting assembly 5. Installing the breech assembly 3 captures the mounting assembly 5 to eliminate rotation inside the chamber and to ensure the device stays firmly seated in the main gun chamber. In an exemplary embodiment, a laser beam (not shown) emitted by the laser emitter 22 may be aligned with the concentric center of the main gun bore 100. The system may be wired so that the laser transmission is activated by the gun's electronic triggering mechanism 102. Optionally, the guns electronic triggering mechanism 102 may be in electrical communication with the loader interface box 14. If a loader interface button is utilized, the unit may require depression of the loader's button 17 in the firing sequence. For example, in one embodiment, pushing the loader interface button 17 might simulate pushing a shell into the main gun bore 100. In that way, the loader's interface box 14 may include the loader by adding a simulated load function. In one embodiment, the loader interface box may contain electronics that provide a simulated blast sound to the loader.

It should be recognized by a person having ordinary skill in the art would understand that the object of a number of elements mentioned may be accomplished with alternative structures. For example, the mounting assembly 5 may be a single molded member having the same or similar geometry and grooves. Alternatively, instead of using a tubular member, a frame-type architecture with support members that connect and support a plurality of conceivable adaptors may be substituted. Similarly, although O-rings are particularly well-suited to promote a compression fit, there are many conceivable means that may be utilized to achieve a stable compression fit. For example, one could attach rubber or plastic tabs equidistantly around the tubular member to achieve a similar compression fit. As the above shows, many alternative structures may be substituted that would still fit within the concept of this invention.

Unless particularly excluded, any disclosed embodiment may include any of the optional or exemplary features of the other embodiments. The exemplary embodiments herein disclosed are not intended to be exhaustive or to unnecessarily limit the scope of the invention. The exemplary embodiments were chosen and described in order to explain the principles utilized, so that others skilled in the art may practice the invention. Having shown and described exemplary embodiments, those skilled in the art will realize that many variations and modifications may be made to affect the described invention. Many of those variations and modifications will provide the same result and fall within the spirit of the appended claims.

What is claimed is:

1. A laser emitter mounting system for a large caliber gun, comprising:

a gun bore mounting assembly including:

an elongated tubular member adapted to be slidably inserted into a gun chamber and compressively secured within the gun bore comprising:

a first end and a second end;

a mounting surface for a laser emitter;

a breech assembly detachably engaged to the mounting assembly, said breech assembly including:

oppositely disposed parallel sides;

a cross-member connecting the oppositely sides;

at least two forwardly extending arms adapted to engage the gun bore mounting assembly; and a piston assembly including a piston cylinder housing and a piston.

2. The mounting system of claim 1, wherein:

the first end and the second end have dimensions that center the orientation of the elongate tubular member to a predetermined gun bore.

3. The mounting system of claim 1, wherein the mounting assembly includes an anti-roll plate fixed to the first end of the elongate tubular member.

4. The mounting system of claim 1, wherein the tubular member is compressively secured within the gun bore by a detachable first gun bore adaptor mounted at the first end of the tubular member with a first groove for receiving a first o-ring; and a detachable second gun bore adaptor mounted at the second end of the tubular member with a second groove for receiving a second O-ring.

5. The mounting system of claim 3, wherein:

the anti-role plate defines an aperture; and the piston is adapted to penetrate the aperture;

wherein the piston includes a shoulder adapted to abut the anti-roll plate.

6. The Mounting system of claim 3, wherein:

the piston assembly further includes a lever arm and a spring;

wherein the piston assembly is adapted to transfer a compressive force to the anti-roll plate.

7. The mounting system of claim 1, further comprising:

a loader interface box secured to the cross-member.

8. The mounting system of claim 7, wherein the loader interface box includes a loader's button.

9. A laser emitter mounting system for a large caliber weapon, comprising:

a mounting assembly adapted to be slidably inserted into a gun chamber, including:

an anti-roll plate;

an elongate support member including a first gun bore adaptor and a second gun bore adaptor positioned at respective ends of the support member;

a mounting surface for a laser emitter;

o-rings positioned on said first and second gun bore adaptors to compressively secure the elongate support member within bore;

a breech assembly, said breech assembly including:

oppositely disposed parallel sides;

a cross-member connecting the oppositely disposed sides;

forwardly extending arms adapted to engage the anti-roll plate; and a piston assembly including a piston cylinder housing and a piston.

10. The mounting system of claim 9, wherein:

the anti-role plate defines an aperture; and the piston is adapted to penetrate the aperture;

wherein the piston includes a shoulder adapted to abut the anti-roll plate.

11. The mounting system of claim 9, further comprising:

a loader interface box secured to the cross-member.

12. The mounting system of claim 11, wherein the loader interface box includes a loader's button.

13. The mounting system of claim 9, wherein:

the piston assembly includes a lever arm and a spring;

wherein the piston assembly is adapted to transfer a compressive force to the anti-roll plate.

14. A method for mounting an in-bore laser emitter in a large caliber gun, comprising:

providing an elongate tubular mounting assembly and a breech assembly, said breech assembly including:

oppositely disposed parallel sides;

a cross-member connecting the oppositely disposed sides;

forwardly extending arms adapted to engage the anti-roll plate;

a piston assembly including a piston cylinder housing and a piston;

fixing a laser emitter to an internal surface of the tubular mounting assembly;

sliding the elongate tubular mounting assembly into a gun bore until the gun bore and the tubular mounting assembly share a common concentric center along the length of the tubular member; and seating a breech assembly to secure the tubular mounting assembly.

15. The method of claim 14, further comprising the steps of:

connecting a laser emitter in electrical communication with a gun's electronic triggering mechanism.

16. The method of claim 14, further comprising the step of:

exerting a continuous forward pressure on the tubular mounting assembly.

17. A laser emitter mounting system for a large caliber gun, comprising:

a gun bore mounting assembly including:

an elongated tubular member adapted to be slidably inserted into a gun chamber and compressively secured within the gun bore comprising:

a first end and a second end;

an anti-roll plate fixed to the first end of the elongate tubular member;

a mounting surface for a laser emitter;

a breech assembly detachably engaged to the mounting assembly, comprising:

oppositely disposed parallel sides;

a cross-member connecting the oppositely disposed sides;

at least two forwardly extending arms adapted to engage gun bore mounting assembly;

a piston assembly including a piston cylinder housing and a piston;

wherein the anti-role plate defines an aperture; and the piston is adapted to penetrate the aperture;

wherein the piston includes a shoulder adapted to abut the anti-roll plate.

* * * * *